United States Patent [19]

Haussonne et al.

[11] 4,348,570

[45] Sep. 7, 1982

[54] ELECTRIC CONTACT DEVICE WITH LIQUID CONDUCTORS

[76] Inventors: François J. Haussonne, Rue des sept tournants, Lannion, France, 22300; Guy Moisan, Croix Gollo, Trebeurden, France, 22560; Hubert Prigent, 8, Res. "Place ar guer", Lannion, France, 22300

[21] Appl. No.: 148,413

[22] Filed: May 9, 1980

[30] Foreign Application Priority Data

May 10, 1979 [FR] France ..... 79 12372

[51] Int. Cl.[3] ..... H01H 29/22; H01H 29/00

[52] U.S. Cl. ..... 200/191; 200/211; 200/235

[58] Field of Search ..... 200/182, 209, 210, 211, 200/212, 213, 268, 279, 61.05, 61.47, 80 A, 81.6, 83 F, 235, 191-193; 335/49, 50, 51, 52

[56] References Cited

FOREIGN PATENT DOCUMENTS 1185724 1/1965 Fed. Rep. of Germany .
1505976 12/1966 France .
1506067 12/1966 France .

*Primary Examiner*—John W. Shepperd
*Attorney, Agent, or Firm*—Alter and Weiss

[57] ABSTRACT

This electric contact device is a variant of those described in Anizan et al., French Pat. No. 2,385,208.

The composite unit formed by the insulating coating and the conducting material form a single insulator-conductor unit. The electrical duct penetrates the insulation to reach the conductor. The composite unit is made of enamelled metal, a metal on which insulation is deposited by "shoopage" (a process apparently involving the deposit of a vaporized metal) or of a cermet (ceramic alloy) from whose surface the metallic phase has been eliminated. The duct may be cylindrical, a groove, or grooves crossing at a right angle.

Usable for many types of electric contact.

5 Claims, 8 Drawing Figures

ELECTRIC CONTACT DEVICE WITH LIQUID CONDUCTORS

Figure 1:
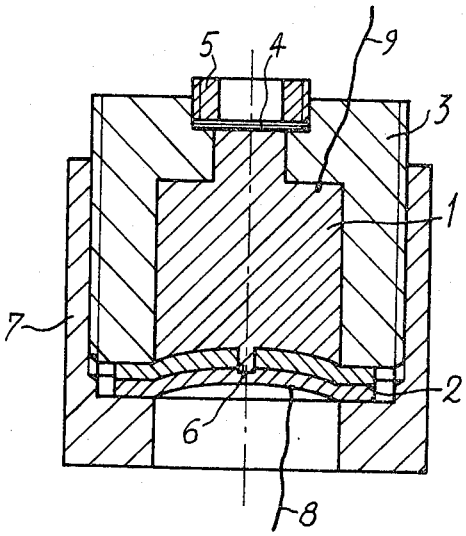

This invention concerns electric contact devices with a liquid conductor which can be used in hand operated electric switches, such as push button switches, automatic switches, such as electromagnetic relays, or switching networks, such as those used in telephonic switching, etc.

In the most often used electric switches, the electric contact devices are formed from two pieces made from an electric conducting metal, one of which is fixed and the other of which is mobile. The moveable piece can be moved so that it touches the fixed piece so as to establish electric contact between the two pieces, or separated from the fixed piece in order to interrupt the electric contact. In the case of an electromagnetic relay the moveable piece is attached to the armature of the relay which causes it to move so as to open and close the contact. In order to be usable in telephone communication systems, a contact device must meet a certain number of needs. It must be able to interrupt or establish an electric contact cleanly, quickly, with a very high resistance between the two contact elements when the device is open, but with a very weak reproducible resistance between the two elements when the contact is closed. These properties should be maintained for a long time, on the order of 20 years. The device should be able to undergo a large number of operations, on the order of $10^8$.

In these contact devices with two metal pieces, however, one often finds an accelerating deterioration of performance, caused by an increase in resistance between the pieces when the contact is closed, the partial destruction of the contact surfaces of the pieces by electric erosion, and the tendency of the pieces to stick together. Indeed, when these contact devices are exposed to the air, the surrounding atmosphere may include, for example, sulfuric compounds which have harmful effects on the contact surfaces. Furthermore, when the contact is opened, short but intense electric arcs are produced in a well known manner; these arcs lead to erosion. In order to overcome these flaws, contact surfaces are sometimes made of precious metals such as silver, palladium, or alloys of precious metals. In other cases, when possible, protection circuits are added for the discharge of the most intense arcs. Nevertheless, these solutions are expensive and only partly successful.

In order to improve the performance of contact devices with two metal pieces, their contact surfaces can be enclosed in airtight containers within which there is an atmosphere whose composition is controlled; a base of nitrogen and hydrogen purified of corrosive compounds is the most often used. In some contact devices of this type, part of the exterior shell of the container is flexible and plays the role of a membrane which makes it possible for some object outside the container to move the movable piece of the contact device, which is inside the container. In other devices of the same type, the exterior shell is rigid, made of glass for example, which means that the pieces have to be made at least partially from a magnetic or elastic material. Furthermore, their contact surfaces are coated with gold, and then with rhodium or ruthenium. Hence these contact pieces are expensive and have to be handled in "white rooms". Finally, sealing the pieces in the containers requires extremely precise settings and rigorous inspection of the manufacturing process, which increases even further the cost of these bulb contact devices (BCD). In an attempt to improve upon the performance of these dry BCD's, engineers have developed devices where the contact surface is covered with liquid mercury by capillary action, which insures a very good, repeated electric contact when the device is closed. However, these wet surface BCD's are even more expensive than the dry BCD's, and, most inconvenient of all, can only function in a single position, because the mercury must gather at a proper previously determined site.

Furthermore, the contact devices currently in use and, in particular, the BCD's, have to be manufactured, checked, and installed one by one. In many applications, however, they are used together in groups. For example, telephone communication centers use switching networks including hundreds of contacts on a punched card. Assembling these individual contact devices requires a great deal of time, which increases the cost of these networks.

There are some contact devices using mercury which do not present these inconveniences. These are structures with a very narrow interior space coated with a non-mercury-absorbent surface. The electric contact is made between the mercury and an electrode placed at the bottom of this space. The narrowness of the space creates capillary action, so that the mercury will only enter it under pressure and so that, when the pressure is interrupted, the mercury is withdrawn from the space, interrupting the flow of electricity. Up to now this space has been created by juxtaposing two parallel plates or by using a capillary tube. Examples of such devices are described in French Pat. Nos. 1,505,976 and 1,506,067, German Pat. Nos. 1185 724 and 1 218 062, and U.S. Pat. No. 2,695,938. The manufacture of a contact device of this type is an extremely delicate operation, and, again, extremely costly.

French Pat. No. 2,385,208 describes a contact structure which includes a porous coating, into whose pores an increase in pressure causes a liquid conductor (not absorbable by this coating) to penetrate, thus establishing electrical contact between the two sides of this coating. It seems that it is then relatively easy to create the type of narrow space appropriate to the particular porous material used for the coating or casing, which could be cloth, a fritted (fused) material, a material made of mineral fibers, etc.

U.S. Pat. No. 3,114,811 describes a relay with a contact moistened with mercury, in which the mercury climbs up an armature 12 by capillary action in order to moisten permanently the conductive surface of the contacts. The fact that the conductive surfaces of the contacts are covered with insulating "spacers" does not prevent the mercury from permanently wetting the bars and the conductive bottoms of the grooves between the bars. The thickness of the bars cannot exceed the thickness of the mercury film between the bars (namely 25 microns), and the distance between the bars must be several mils, i.e. on the order of 100 microns or more, so that the mercury moistening the contact surface between the bars forms a layer of liquid mercury whose thickness is equal to or greater than that of the bars.

French Pat. No. 2,312,847 also describes a contact device wherein the subjacent metal is wetted with mercury. It is thus a contact device of the same type as that described in U.S. Pat. No. 3,114,811, mentioned above.

The dimensions of the opening envisioned are quite interesting.

One of the purposes of the present invention is to create a structure with a narrow space that functions through the effect of capillary action on a non-moistening liquid conductor. This structure would be simpler than those devised previously.

One version of the invention includes a structure in which the insulating coating or casing and the conductive layer that the liquid conductor reaches through the narrow spaces of the coating together form a composite insulator-conductor material.

Another version of the said structure is made of a plate of insulating material penetrated by one or several holes or by one or several grooves, on which a layer of metal has been deposited by "shoopage".

Another version of the said structure is formed of a cermet, the metal of which has been eliminated on one of the faces of the ceramic skeleton to the appropriate depth.

Further, according to the invention, the duct in the insulating casing is narrow enough so that the pressure at rest is insufficient to force the mercury all the way to the conductive bottom of the duct. The manner of operation of the contact is thus completely different from that of the relay described in U.S. Pat. No. 3,114,811.

Figure 6:
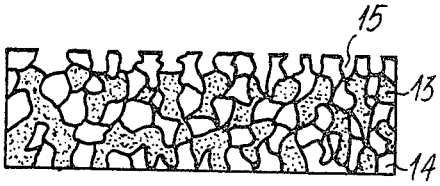
Figure 7:
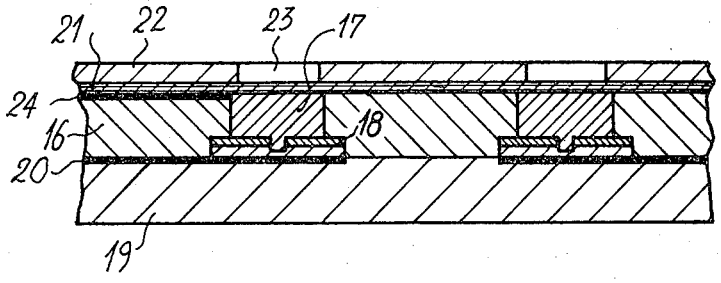
Figure 8:
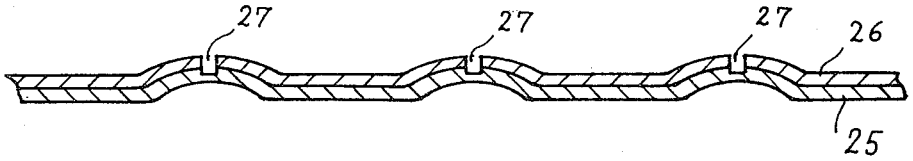
Figure 9:
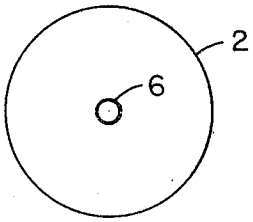

The characteristics of the abovementioned present invention as well as of others will appear more clearly in the following description of particular models. The description relates to the attached drawings, among which are:

FIG. 1, a view in longitudinal cross-section of a first example of an electric contact designed as in the invention;

FIGS. 2 to 5, views from above of various structures of the invention;

FIG. 6, a view in cross-section of a second example of a structure designed according to the invention;

FIG. 7, a view in cross-section of a set of contacts designed according to the invention; and FIG. 8, a view in cross-section of a variant of the set shown in FIG. 7.

The cross-section in FIG. 1 shows a compartment 1, filled with mercury, which is bounded by a bottom made of enamelled sheet iron 2, a cylindrical casing 3 of non-conductive material, and, finally, a flexible membrane 4 which closes off the cavity defined by cylindrical casing 3 transversally. In practice, in the upper part of the cavity the diameter of the casing is smaller, and membrane 4 is held in place by a hollow plug 5, which may be, for example, screwed into the end of the cavity. Membrane 4 makes it possible to transmit variations in pressure from the outside to the inside of the cavity, that is, to the mercury. The enamelled sheet iron 2, the enamelled part of which faces the inside of the cavity, that is, the mercury, includes a groove 6 which crosses the enamel layer and is open towards the mercury. The piece of enamelled sheet iron 2 has a generally circular shape, with the central part pushed out so as to present a convex surface towards the inside of cavity 1. The edges of piece 2 are held against the lower face of piece 3 by adequate means of clamping, for example by the core of nut 7 which is screwed onto piece 3. Current intake wire 8 is attached to the metal part of piece 2, while current intake wire 9 is connected to the interior surface of the cavity, that is, to the mercury conductor, through a hole in casing 3.

As for the mechanical model shown, the cylindrical piece 3 is threaded on the outside so as to be able to be screwed into nut 7. The bottom of the latter is hollow to allow for the insertion of wire 8, which is soldered to the lower surface of sheet metal chip 2. At the other end of piece 3 there will be a coaxial threaded hole in which plug 5, which binds the edges of membrane 4, is screwed. For the connection of wire 9, there will be a hole in piece 3 (hole not shown). In this hole will be inserted a core of metal conducting material, the end of which will come in contact with the mercury in the cavity. As far as the assembly of the contact is concerned, chip 2 is first attached with the help of piece 3 and nut 7; next the cavity is filled with mercury, and finally, membrane 4 is fixed in place with the help of plug 5. The electrical connections should have been put in place before these operations.

Groove 6 in the enamelled part of 2 is deep enough to expose the sheet metal. Its width, for example, could be about 75 thousandths of a millimeter. When no pressure other than atmospheric pressure is exerted upon the membrane, the capillary forces at the level of groove 6 prevent the mercury from penetrating into the groove and thus coming in contact with the latter's conductive bottom. As a result the electric current cannot pass between wire 8 and 9, through chip 2. When a pressure larger than a certain threshold determined by the width of the groove is exerted on membrane 4, the mercury enters the groove and reaches the conductive bottom and creates a flow of electricity between wires 8 and 9. As soon as this pressure on membrane 4 is stopped, the capillary forces force the mercury to withdraw from groove 6, breaking off the electric flow.

Since part of chip 2 is convex to the interior of the cavity, the groove can be made with a simple saw stroke.

Figure 2:
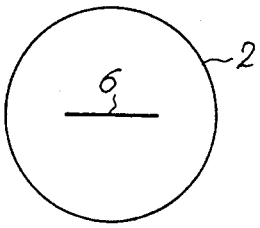
Figure 3:
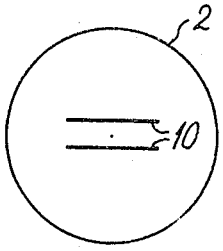
Figure 4:
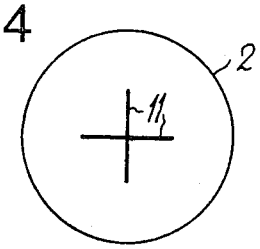
Figure 5:
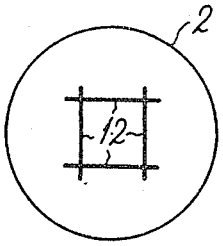

FIG. 2 shows a view from above of a chip (2) on which a single groove 6 has been traced. FIG. 3 shows an analogous chip made of enamelled sheet iron, the enamelled part of which has been cut with two saw strokes, creating two parallel grooves 10, which should preferably be symmetric with respect to the center of the chip. FIG. 4 shows another similar chip on which there are two grooves crossing each other in the center of the chip (11). FIG. 5 shows another similar chip on which there are four grooves 12 forming a square. One can, of course, substitute any one of the chips shown in FIGS. 3 to 5 for chip 2 in FIG. 1. Multiple grooves diminish the electrical resistance of the contact piece when the contact is closed.

It should also be noted that the convex shape of the chips makes it possible to manufacture them using wire saws, without making the grooves too long.

In place of enamelled sheet iron, one could also make chip 2 out of an iron plate on which aluminum is deposited by shoopage. The grooves are then made in the same way as described previously.

In another variant of the chip, the plate of enamelled sheet iron can be replaced by an aluminum plate 0.5 mm thick, for example. The aluminum sheet should be pierced by a hole about 0.5 mm in diameter, and one of its sides should be covered with iron by shoopage. This deposit of iron closes off the bottom of the hole. The mercury wets the aluminum side and does not penetrate into the hole, as long as a particular threshold of pressure is not exceeded. Naturally, the dimensions given above are only given by way of example.

In another version of the chip, it is made of a magnesium-nickel cermet. This is a composite material formed from two frameworks or skeletons, one ceramic and the other metal, which overlap each other. In one of the preferred examples the average diameter of the particles of magnesium is about 10 microns. The metallic phase was removed from one side of the chip to a depth of about 200 microns by the classic technique of dissolving nickel in an anodic fluid.

FIG. 6 shows a cross-section of such a chip made of a cermet. It shows, at 13, the metallic phase made of nickel, overlapping with skeleton 14, made of magnesium. The empty areas 15 on one of the sides of the chip were formed by electrochemical action against the metal. In operation the mercury penetrates these empty spaces 15 when it is subjected to a certain amount of pressure, thus establishing an electrical contact between itself and the nickel in the cermet. When this pressure is relaxed, capillary forces cause the mercury to withdraw from these empty spaces, breaking off the electrical connection. The chip in FIG. 6 can be used in place of that in FIG. 1.

FIG. 7 shows a cross-section along one coordinate of a network of contacts made of contact devices similar to that shown in FIG. 1. The cylindrical body 3 is replaced by an insulating plate 16, pierced with holes 17 which replace the cavities 1. Each hole 17 includes a cylindrical part of one diameter, which forms the cavity properly speaking, and, below that part, another cylindrical part which is shorter and of larger diameter, so as to form a sort of buttress to which are attached the edges of the chips (18), analogous to chip 2. Chips 18 are held in position by plate 19, parallel to plate 16, which plays the same role as nut 7. On the appropriate side of 16 and 19 the classic technique of buttress to which are attached the edges of the chips (18), analogous to chip 2. Chips 18 are held in position by plate 19, parallel to plate 16, which plays the same role as nut 7. On the appropriate side of 16 and 19 the classic technique of printed circuits is used to deposit electrical connections 20 which give access to chips 18 either separately or by groups. Once the mercury is poured onto the holes 17, elastic layer 21 is attached to plate 16. This elastic layer is then sandwiched between 16 and another plate 22, which plays the same role as plug 5. Plate 22 has holes 23 directly across from holes 17, so that the elastic layer 21 forms a set of individual membranes between each hole 23 and the corresponding hole 17. Further, on the upper side of plate 16 there are electrical connections 24, analogous to 20, which are in contact with the mercury in holes 17. Thus the membranes over each hole 17 can be operated individually, making possible selective opening and closing of the electric circuits between connections 20 and 24.

In another variant of the chip, there is a common electrode for all the contacts made of a plate of enamelled sheet iron, with convex outcroppings from place to place. The enamel is pierced by as many ducts as there are contacts. This plate is enclosed between other plates in a way similar to the example shown in FIG. 7. In place of a single plate, there could obviously be whole strips of contacts. An example of such a device is shown schematically in FIG. 8, with sheet iron 25, analogous to chip 2, being convex in certain places, with holes or grooves 27, analogous to 6, at the top of the convex parts.

What is claimed is:

1. Electric contact devices using an electrically conductive liquid enclosed in a sealed container, at least one surface or coating which is made of an electrically conductive material; an insulating material which will not absorb said liquid, said insulating material positioned intermediate said liquid and said conductive material; means of exerting pressure on said liquid; said insulating material being penetrated by at least one duct of a width such that, in a state of rest, capillary forces prevent the penetration of said liquid in said duct, while, when sufficient pressure is exerted, said liquid penetrates into said duct, establishing an electrically conductive path between said liquid and said conductive material, and such that, when said pressure ceases and the liquid returns to said state of rest, said liquid withdraws from said duct, thus breaking off said electrically conductive path; said device being characterized by the fact that the unit constituted by said insulating material and said conductive material is formed as a single composite enamelled metal insulator-conductor unit.

2. Device as described in claim 1, characterized by the fact that the said duct consists of a groove.

3. Device as described in claim 2, characterized by the fact that the said duct consists of grooves crossing at a right angle.

4. Device as described in claim 1, wherein said insulating material has a cylindrical duct formed therethrough.

5. Device as described in claim 1, characterized by the fact that said composite insulator-conductor unit consists of a cermet, the metal phase of which has been removed from one surface.

* * * * *